United States Patent [19]

Reinhard et al.

[11] 4,292,823

[45] Oct. 6, 1981

[54] CYLINDER LOCK WITH PLATE TUMBLERS

[75] Inventors: Theodor Reinhard, Böblingen; Rolf Krügener; Hermann W. Kurth, both of Sindelfingen; Diether Blaich, Stuttgart; Franz Rothmaier, Velbert; Dieter Kopperschläger, Sprockhövel; Heinz Schmitz; Edgar Nill, both of Velbert, all of Fed. Rep. of Germany

[73] Assignee: Daimler-Benz Aktiengesellschaft, Stuttgart, Fed. Rep. of Germany

[21] Appl. No.: 26,602

[22] Filed: Apr. 3, 1979

[30] Foreign Application Priority Data

Apr. 10, 1978 [DE] Fed. Rep. of Germany ..... 2815380

[51] Int. Cl.[3] ..... E05B 15/14; E05B 29/02

[52] U.S. Cl. ..... 70/364 R; 70/377; 70/419

[58] Field of Search ..... 70/364 R, 377, 376, 70/392, 419, 416

[56] References Cited

U.S. PATENT DOCUMENTS 2,019,655 11/1935 Centofanti .

FOREIGN PATENT DOCUMENTS

| | | | |
|---|---|---|---|
| 509838 | 3/1952 | Belgium | 70/364 R |
| 2061236 | 6/1972 | Fed. Rep. of Germany | 70/364 R |
| 1242806 | 11/1946 | Switzerland | 70/364 R |

*Primary Examiner*—Robert L. Wolfe

*Attorney, Agent, or Firm*—Craig and Antonelli

[57] ABSTRACT

A cylinder lock which includes plate tumblers in a lock cylinder and a locking channel arranged in a lock casing wherein, when the key is pulled out (locked position of the lock), spring-loaded plate tumblers engage with their locking ends into the locking channel up to an extension length determined by locking stops. The lock casing is provided with an escape channel diametrically opposed to the locking channel for enabling a free resetting motion of the plate tumblers with their counter ends during an insertion of the key. The plate tumblers have, in their key cutouts, tumbler edges arranged at levels corresponding with an associated key cutout depth and, with a key being inserted (free position of the lock), can be reset into the lock cylinder. Stops are provided for limiting the resetting motion of the individual plate tumblers in the escape channel at insertion depths and a varying arrangement of the blocking stops is made in dependence upon a height of the respective tumbler edge.

13 Claims, 9 Drawing Figures

Figure 1:
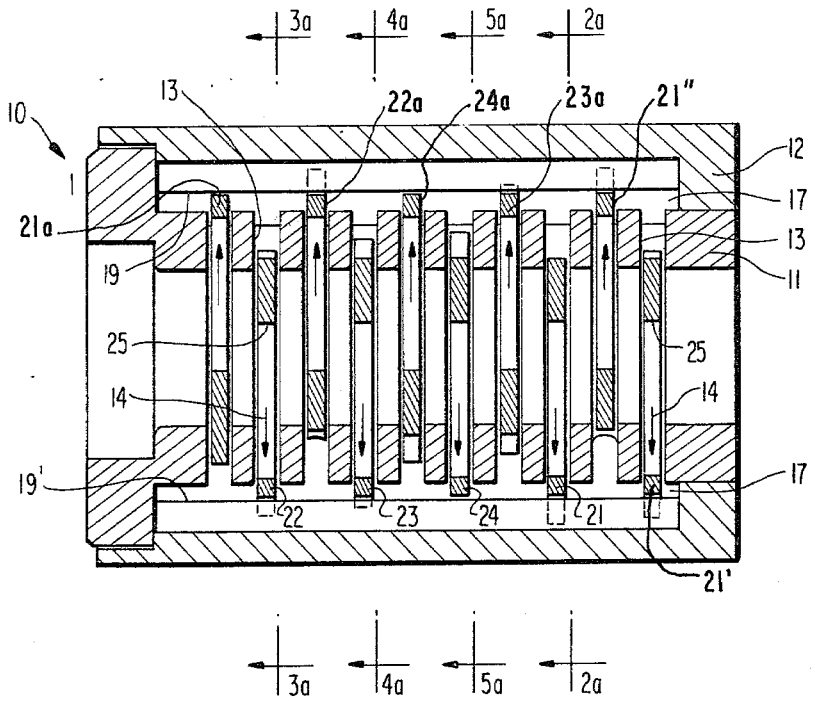

FIG 3a
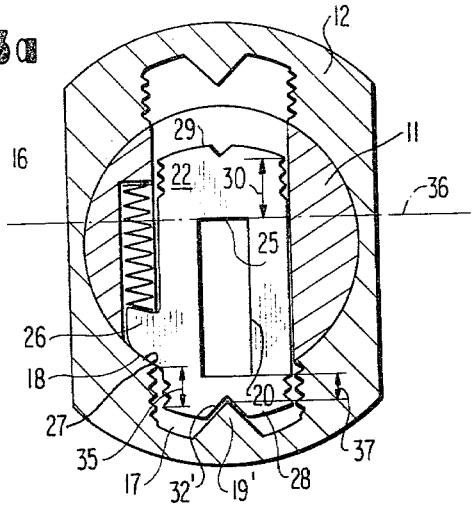
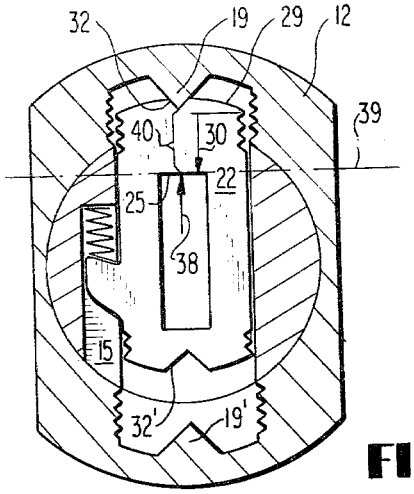
FIG 3b
FIG 4a
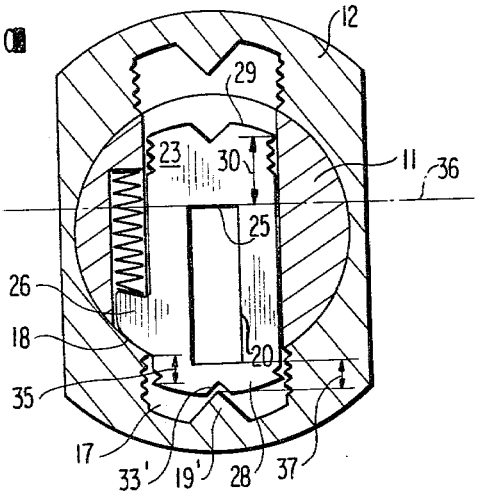
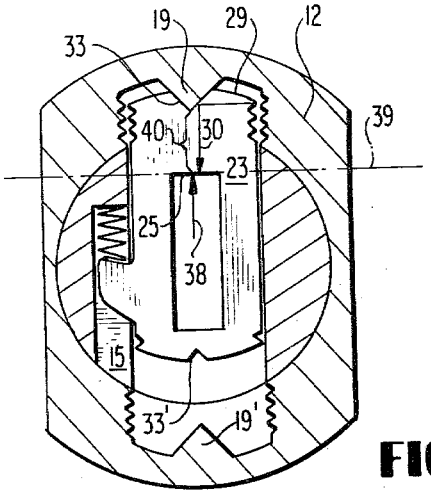
FIG 4b
FIG 5a
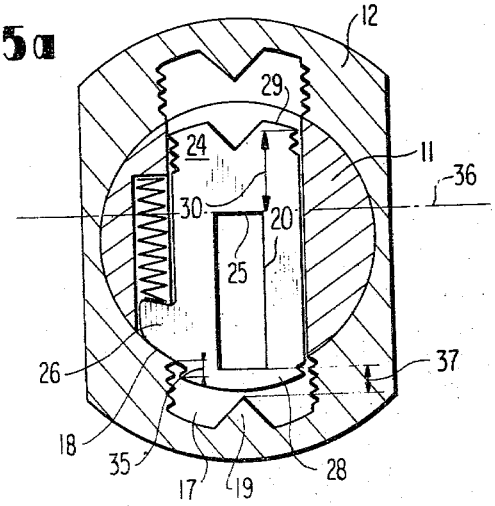
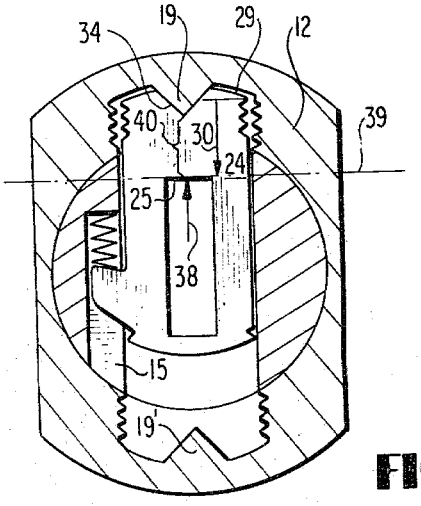
FIG 5b

CYLINDER LOCK WITH PLATE TUMBLERS

The present invention relates to a lock arrangement and, more particularly, to a cylinder lock provided with tumblers in the form of small plates arranged in a lock cylinder, and with a locking channel provided in a lock casing wherein, when a key is pulled out of the cylinder lock, i.e., a locked position of the cylinder lock, the plate tumblers, which are spring-loaded, engage with locking ends thereof into a locking channel up to an extension length determined by blocking stops, and with the lock casing having an escape channel diametrically opposed to the locking channel, for a free resetting motion of the plate tumblers with counter ends thereof during an insertion of the key, and with the plate tumblers having, in associated key cutouts, tumbler edges arranged at levels corresponding with associated key cutout depths such that, when a key is inserted, that is, a free position of the lock, the tumblers can be reset into the lock cylinder.

The safety of a locking system depends upon, among other things, the extent to which it is possible to prevent a determination of the respective heights of the individual tumbler edges in the various plate tumblers in the installed lock by means of, for example, break-in tools for, upon making such a determination, it would then be possible to produce an unauthorized duplicate key.

In proposed locking systems, the determination of the respective heights of the tumbler edges has not been sufficiently avoided so that it has been possible to indirectly determine a height of the individual tumbler edges by determining the respective extent of the possible resetting motion of the plate tumbler during an introduction of its counter end into the escape channel. From this measured value it is then possible to determine a height of the tumbler edge.

The aim underlying the present invention essentially resides in providing burglar-proof characteristics for a cylinder lock so that it is no longer possible to indicate, through manipulations and measurements at the key recesses of the plate tumblers, the respective heights at which the tumbler edges of the cylinder lock are located.

According to advantageous features of the present invention, stop means are provided for limiting a resetting motion of the individual plate tumblers in the escape channel at varying insertion depths and the arrangement of the blocking stops at the plate tumblers is varied in dependence upon the height of the respective tumbler edges.

Due to the height arrangement of the blocking stops at the various tumbler plates, in a locked condition of the plate tumblers, the individual tumbler edges are, in an ideal situation, at a coincident height location. Once this is achieved, the height position of the tumbler edge, in the locked starting position of the cylinder lock, can no longer be used to indicate the staggered heights at which the individual tumbler edges are disposed.

Moreover, due to the varying insertion limitation of the plate tumblers during a resetting motion into the escape channel, it is also not possible to determine the staggered height of the tumbler edges by means of a displacement of the plate tumblers, due to the provision of the stops at that point.

In an ideal situation, the stops of the present invention are fashioned, with respect to their height, in such a way that, even during a resetting motion, the various tumbler edges enter only one coinciding height position. In this way it is likewise impossible to indicate the actual staggered heights in a key recess of the plate tumbler. Also, in this respect, all plate tumblers would indicate the same condition.

For constructional reasons, in some cylinder locks, it is difficult to place the tumbler edges of all plate tumblers at a single extended height or reset depth. However, in such a situation, it is at least possible in accordance with the present invention, to provide for a coinciding height positioning of the respective tumbler edges of at least one group of plate tumblers whereby an actual staggered height of the various tumbler edges in the key recess would be concealed or obscured. Even if it is possible to somehow reduce the great variety of possible staggered heights to a few arranged positions, it would still be impossible to accurately indicate the staggered height at which the tumbler edge is located within such a group of plate tumblers. Thus, for example, it is possible in a cylinder lock having two-way or alternating spring-loaded plate tumblers and a turnable key to, starting with plate tumblers having four different staggered heights of their tumbler edges, restrict such tumblers in two extension heights and/or insertion depths whereby it would still be impossible to provide an indication or permit a determination of the actual staggered height because each height would have hidden therein two possible height arrangements of the tumbler edges.

Moreover, in obscuring of the height at which the various tumbler edges are arranged may also be achieved in accordance with the present invention by positioning or selecting the aforementioned stops in a deviation from the staggered height and providing, for example, varying abutment positions in the plate tumblers actually exhibiting a coincident height position of the tumbler edges; however, a construction of this nature would be somewhat more expensive.

To most simply achieve a desired positioning of the stops, in accordance with the present invention, projections may be provided in an escape channel and/or also in the locking channel which projections extend at an end face against a counter end and/or locking end of the individual plate tumblers.

To avoid an additional expense for an individual projection height in dependence upon a particular plate tumbler used at a given location, advantageously, according to the present invention, the stop projections are formed from a longitudinal rib having a constant rib height with the counter ends and/or locking ends of at least some of the plate tumblers being provided with cutouts having a varying cutout depth which cutouts cooperate with the longitudinal rib.

From a manufacturing viewpoint, in accordance with the present invention, a uniform longitudinal rib may be provided in the lock casing with the various individual stop heights being simply obtained by varying the depth of the cutouts at the end faces of the plate tumblers. Most advantageously, the stop projections may be arranged in the longitudinal plane of symmetry of the escape channel and/or locking channel and, to obtain a large area contact action, be fashioned of a complementary profile to the cutouts in the plate tumblers.

It is also especially advantageous from a manufacturing viewpoint, to utilize an identical angular profile for the stop projections and associated cutouts and also to provide herein only for a penetration depth of the angular profile into the cutouts individually in accordance with a staggered height of their tumbler edges.

In cases of a cylinder lock designed with two-way or alternating arranged plate tumblers, it is advantageous in accordance with further features of the present invention, to dispose the stop projections disposed in the locking channel and/or the escape channel so that their mutual profiles are identical and to place such projections in a mirror-image relationship within the lock casing. This particularly holds true if the above-mentioned longitudinal ribs are utilized to form the stop projections. In this connection, it is unnecessary to produce the blocking stops by the stop projections in the locking channel and the cutouts at the locking end of the plate for here it is also possible to utilize a differing height arrangement of the rear edge of lugs of the various plate tumblers which lugs absorb the spring load. In such a case, it is expedient in accordance with the present invention, to reduce the distance between a rear edge of the lug and a locking end of the plate with an increasing distance of the tumbler edge in the key recess from the counter end of the plate tumbler at least within one group of different plate tumblers whereby, the above-noted coincident height positioning of the tumbler edges in the locked starting of the cylinder lock can be achieved.

In accordance with still further advantageous features of the present invention, for thoroughly concealing or obscuring an actual staggered height of the tumbler edges, it is possible to maintain the spacings and distances indicated therein in a dimension of the key recesses and cutouts as well as stop projections. For example, with an increasing distance of the tumbler edge in the key recess from the outermost plate counter end, the cutout depth may decrease in the respective plate tumblers at the counter end and/or locking end.

Moreover, within a group of different plate tumblers, the distance may be constant between the cutout base and the tumbler edge in the key recess and, in a locked condition of a lock, at least within a group of different plate tumblers, the distance may be constant between the tumbler edge in the key recess and the ridge of the stop projection in the locking channel.

According to the present invention, the cylinder lock with the blocking stops may consist of the cylinder guide surface in the lock casing on the one hand and a rear edge of lugs of the plate tumblers absorbing the spring load, on the other hand, and, at least within a group of different plate tumblers, with an increasing distance of the tumbler edge in the key recess from the counter end of the plates, the distance may be reduced between the lug and rear edge and the plate locking end.

Accordingly, it is an object of the present invention to provide a cylinder lock arrangement which avoids, by simple means, shortcomings and the disadvantages encountered in the prior art.

Another object of the present invention resides in providing a cylinder lock arrangement by which a determination of the respective positions of plate tumblers in the cylinder lock is impossible.

A further object of the present invention resides in providing a cylinder lock arrangement which is simple in construction and therefore relatively inexpensive to manufacture.

Yet another object of the present invention resides in providing a cylinder lock arrangement by which it is possible to achieve a coincident height positioning of the tumbler edges in a lock starting condition of the lock.

Figure 2A:
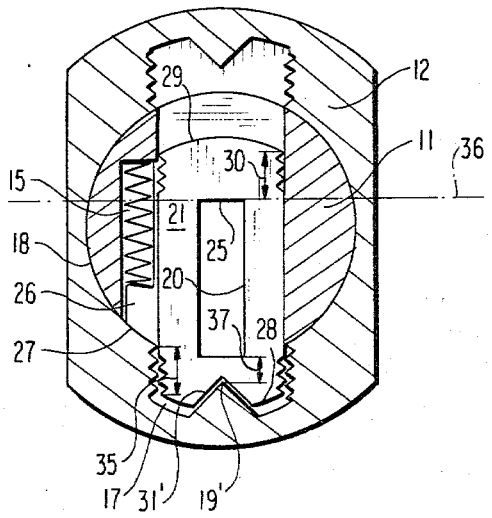
Figure 2B:
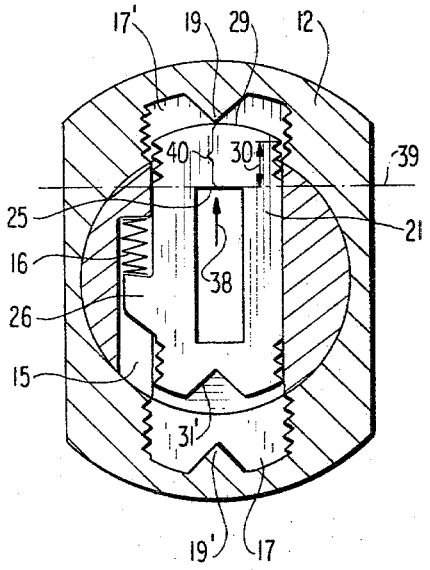

These and other objects, features, and advantages of the present invention will become more apparent from the following description when taken in connection with the accompanying drawings which show, for the purposes of illustration only, one embodiment in accordance with the present invention, and wherein:

FIG. 1 is a longitudinal cross-sectional view of a portion of a cylinder lock in accordance with the present invention;

FIGS. 2*a* and 2*b* are cross-sectional views of the cylinder lock of FIG. 1 taken along the line IIa—IIa;

FIGS. 3*a* and 3*b* are cross-sectional views of the cylinder lock of FIG. 1 taken along the line IIIa—IIIa of FIG. 1;

FIGS. 4*a* and 4*b* are cross-sectional views taken along the line IVa—IVa; and FIGS. 5*a* and 5*b* are cross-sectional views of the cylinder lock of FIG. 1 taken along the line Va—Va of FIG. 1.

Referring now to the drawings wherein like reference numerals are used throughout the various views to designate like parts and, more particularly, to FIG. 1, according to this figure, a cylinder lock generally designated by the reference numeral 10 includes a lock housing or casing 12 for rotatably receiving a lock cylinder 11 which serves by way of, for example, ten transversely extending chambers 13, for alternatingly accommodating mutually oppositely extending plate tumblers 21', 21, 22, 23, 24 and 21'', 21*a*, 22*a*, 23*a*, 24*a*. In the illustrated embodiment, the cylinder lock 10 is suitable for use with a so-called reversible key which may be inserted in two ways in the lock cylinder 11 without having to pay any attention to the orientation of the key ward. However, the principles of the present invention are likewise applicable to other types of cylinder locks.

In the illustrated embodiment, the individual plate tumblers 21'–24 and 21''–24*a* are each provided with a window-like recess 20 with one end thereof, disposed in opposition to a spring bias the direction of which is indicated by the arrows 14, forming a governing tumbler edge 25 which cooperates in each instance with a key ward (not shown) when positioning or assorting the various tumbler plates in the cylinder. However, the tumbler plates 21'–24 and 21''–24*a* could also be fashioned as so-called half plates with unilateral cutouts serving as the key recess 20. It is also possible to provide the tumbler edges 25 in a step-like form within a window-like key recess 20.

As shown most clearly in, for example, FIGS. 2*a* and 2*b*, the lock cylinder 11 is respectively and alternatingly provided on one of its side with a flaring portion 15 which merely opens to one side and which is adapted to be engaged by an associated plate tumbler respectively by way of a lug 26 formed on the respective tumblers. One end of a compression spring 16 rests, in each instance, on an end face of the lug 26 while an opposite end of the compression spring 16 rests on an end of the flaring portion 15 of the chamber 13.

FIGS. 2*a*–5*a* provide an example of different constructional features of four different plate tumblers 21, 22, 23, 24, with the plate tumblers 21–24 being illustrated in a position assumed with a locked condition of the cylinder lock 10; whereas, FIGS. 2*b*–5*b* illustrate the four different plate tumblers 21–24 in their respective maximum resetting position in an escape channel 17.

As shown in FIGS. 2a–5a, the compression spring 16 is effective to cause the spring bias in the direction of the arrow 14 in FIG. 1 on the respective plate tumblers 21–24 whereby the tumblers 21–24 are pushed out with their respective locking ends 28 into a locking channel 17 of the lock casing 12 so that the cylinder lock 10 is in a locked condition and locked members, (not shown), arranged at the lock cylinder 11, are in a closed position. The locked condition of the cylinder lock 10 exists when the key has been pulled out and the spring bias of the compression spring 16 is then fully effective.

In spite of differing height arrangements of the respective tumbler edges 25 of the plate tumblers 21–24, such heights cannot be distinguished from one another as viewed through the key recess 20 by virtue of the provision of blocking stops to be described more fully hereinafter. By virtue of the provision of the blocking stops or projections, it is impossible to determine or obtain any indication of the actual height location of the tumbler edges 25 of the individual plate tumblers 21–24. In the illustrated embodiment, the blocking stops or locking abutments may be obtained by a specific height positioning of the lugs 26.

As shown in FIGS. 2a–5a, in the locked condition of the cylinder lock 10, an extension length of the various plate tumblers is defined by a contact of rear edges 27 of the respective lugs 26 against an internal cylindrical guide surface of the lock casing 12. Thus, the blocking stops, in the illustrated embodiment, are produced by the cylindrical bore 18 of the lock casing 12 and rear edges 27 of the respective lugs 26.

The four different plate tumblers 21, 22, 23, 24 are disposed in the cylinder lock 10 so that the tumbler edges 25 are arranged in four staggered heights. The four tumblers 21–24, as shown in FIG. 1, form a group of tumblers which are oriented in a downward direction. The mutually oppositely disposed plate tumblers 21a, 22a, 23a, 24a are disposed in a reversed mirror-image arrangement. The respective selection of the type of plate tumbler utilized at a specific location determines the individual characteristics of the cylinder lock 10.

In correspondence with the four types of plate tumblers 21–24 or 21a–24a, as shown in FIGS. 2a–5a, to provide for the blocking stops 18, 27 to define a differing extension length of the respective plate tumblers, the lugs 26 are formed with their rear edge 27 at different heights at the respective plate tumblers.

As shown most clearly in FIG. 5a, the plate tumbler 24, which has the deepest stage of the tumbler edge 25, has a rear edge 27 of the lug 26 disposed in its lowermost position in closest proximity to the locking end 28 of the plate tumbler 24. Thus, the plate tumbler 24 extends, when the key has been pulled out, only with a short section of its locking end 28 into the locking channel 17 of the lock housing 12.

In order to obtain, for example, a rising staggered height of the tumbler edges 25 of the respective tumblers 21–24 in the key recess 20, as shown in FIGS. 2a–4a, the lug 26 of the respective plate tumblers 23, 22, 21 rises with its rear edge 27 into a higher position so that an extended length of the locking end of the respective plate tumblers projects by an increasingly longer section into the locking channel 17. Thus, the plate tumbler 21 has the tumbler edge 25 arranged at the highest level with a maximum extended length of the locking end 28 into the locking channel 17. The amount of variance of the distance between the lug rear edge 27 and locking end 28 is designated by the reference numeral 35. Additionally, FIGS. 2a–5a illustrate the increased spacing or distance designated by the reference numeral 30 between an opposed counter end 29 of the respective tumbler plates 21–24 and a respective height of the tumbler edge 25.

Moreover, as can be seen from FIGS. 2a–5a, there is a reciprocal relationship between the spacing designated 30 and the distance designated 35 and, at the same time, a height line 36 clearly illustrates the attainment of the desired result of the present invention whereby the tumbler edges 25 of the tumbler plates 21–24 lie in a coincident height position when the key is pulled out of the cylinder lock 10. It can also be seen from these figures that there is a constant dimensional configuration for all of the tumbler plates 21–24 as evident by the space or dimension designated by the reference numeral 37 wherein use is made of the coinciding dimensioning between a reference point 19′ of the locking channel and a lower end of the key recess 20.

FIGS. 2b–5b provide an illustration of the manner by which it is impossible to determine an individual height positioning of the tumbler edge 25 upon a resetting motion of the tumbler plates 21–24 of the cylinder lock 10. In these figures, the four different plate tumblers 21–24 are brought into a maximum resetting position and, in correspondence with differing staggered heights of the tumbler edges 25, represented by the differing spacings 30, stops are arranged in the escape channel 17′ which is disposed in an opposed relationship to the locking channel 17. The stops in the escape channel 17′ cooperate with the counter end 29 of the respective plate tumblers 21–24.

In the illustrated embodiment, the stops are formed by a longitudinally extending rib 19 arranged in the escape channel 17′ of the lock casing 12 with the rib 19 having a continuously constant rib height. By an interaction of the top or upper surfaces of the longitudinal rib 19 with the counter ends 29 of the respective plate tumblers 21–24, it is also possible, if the plate tumblers 21–24 are moved backwardly, in the direction of the arrows 38, against the bias of the compression springs 16 by, for example, a tool or the like, to attain a coinciding height position of the varying tumbler edges 25 as indicated by the dot-dashed height or level line 39. Therefore, even with a resetting motion, it is impossible to detect the individual height or position of the respective tumbler edges 25 of any of the plate tumblers 21–24 and, for this purpose, as shown in FIGS. 2b–5b, the counter ends 29 of the plate tumblers 21–24 each have different configurations from each other.

More particularly, as shown in FIG. 2b, the plate tumbler 21 has the highest level position of the tumbler edge 25 by virtue of the relatively short distance or space 30, with the smooth counter end 29 of the plate tumbler 21 being in direct contact with a tip of the longitudinal rib 19 disposed in the escape channel 17′, which rib 19 is illustrated as having a triangular cross-sectional profile. By virtue of the configuration of the counter end 29 of the plate tumbler 21 and direct contact of such counter end with the tip of the longitudinal rib 19, a more extensive resetting motion of the plate tumbler 21 is impossible. In the subsequent staggered height of the tumbler edge 25 of the plate tumbler 22, shown in FIG. 3b, the counter end is provided with a cutout or notch 32 having a predetermined depth which cutout 32, during a resetting motion in the direction of the arrow 38, is finally engaged by the ridge of the longitudinal rib 19 provided with a corresponding section of its height.

As evident from the space or distance 30 in FIG. 4*b*, the next following plate tumbler 23 is provided with a somewhat deeper cutout or notch 33 is provided which, in case of a resetting motion in the direction of the arrow 38, accommodates a correspondingly longer section of the height at the ridge of the longitudinal rib 19.

As shown in FIG. 5*b*, the tumbler plate 24 is provided with the largest or lowest cutout or notch 34 at the counter end thereof so that the tumbler edge 25 is disposed at the lower level. By virtue of the size of the cutout 34, almost the entire longitudinal rib is accommodated in the cutouts 34 during a resetting motion.

Due to the above-noted construction of the tumbler plates 21–24, in all of such plates, the distance between the base of the cutout of the various cutouts or notches 32, 33, 34 and the respectively associated tumbler edge 35, as evident from the spacing or dimension designated 40, is made to be constant. Additionally, in the case of the tumbler plate 21 wherein the so to speak "cutout depth" is equal to zero, the constant space 40 is provided between the outer edge of the counter end and the tumbler edge 25.

As noted above, the lock cylinder 11 is provided with oppositely arranged plate tumblers 21'', 21*a*, 22*a*, 23*a*, 24*a*, such that, as shown in FIG. 1, the tumbler plates 21'–24 and 21''–24*a*, emerge from the chambers 13 of the lock cylinder 11 alternatingly in the upward and downward directions. Consequently, the controlling locking channel for the various successive plate tumblers serving, when the key has been pulled out, as an entrance for the respective tumbler plates, is arranged in each case alternatingly on one and the other side of the lock casing 12. Thus, for successive plate tumblers, the two mutually diametrically opposed channels 17, 17' respectively exchange their functions as a locking channel and an escape channel. More particularly, for the plate tumblers 21''–24*a*, the locking channel 17 functions as an escape channel; whereas, the escape channel 17' functions as the locking channel as evident from an inspection of FIG. 1 which illustrates the various plate tumblers 21'–24 and 21''–24*a* when the cylinder lock 10 is in a locked condition. However, since a longitudinal rib 19 is employed to provide for a resetting motion of the plate tumblers, forming the aforementioned stop projections, a rib must also be provided for the respectively neighboring plates in the channel 17 which such channel functions as a locking channel for the downwardly acting plates shown in FIGS. 2*a*–5*b*. Therefore, the aforementioned reference point 19' is formed as a longitudinally extending rib arranged in the channel 17.

In order to avoid that this further longitudinal rib in the locking channel 17, which channel otherwise serves for receiving the locking end 28 of the tumbler plates 21'–24, interferes with its depth of penetration with the above-noted blocking stops in the zone of the lug 26, the locking ends 28 of the plate tumblers 21'–24 are also provided with a predetermined configuration for cooperation with the further longitudinal rib. For this purpose, the locking ends 28 of the plate tumblers 21, 22, 23 are provided with cutouts or notches 31', 32', and 33' each of which differs in correspondence with a level at which the tumbler edge 25 is arranged as shown most clearly in FIGS. 2*a*–4*a* and 2*b*–4*b*, respectively.

As shown in FIGS. 5*a*, 5*b*, only the locking end 28 of the tumbler plate 24, exhibiting the lowermost position or space 30 of its tumbler edge 25 is provided with a smooth contour. As can also be seen from the drawings, the depth of the cutouts 31', 32', 33' is the shallower, the deeper the tumbler edge 25 is positioned. To provide that the blocking stops at the lugs 26 determine an unequivocal height positioning of the tumbler plates 21–24 in a locked condition of the cylinder lock 10, the cutout depths 31', 32', 33' are fashioned to be somewhat more pronounced so that, in a normal case, no contact takes place with the ridges of the further longitudinal rib at that location.

However, instead of the aforementioned blocking stops provided at the lugs 26, it is also possible to place the cutouts 31', 32', 33' of the locking ends 28 in a stop-like cooperation with the associated further longitudinal rib provided in the locking channel 13 in the same manner as the cooperation between the counter ends 29 and the longitudinal rib 19.

In the illustrated embodiment, the stops are arranged in the longitudinal plane of symmetry of the cylinder lock 10 and are fashioned to be identical in mirror-image symmetry in the form of triangles. However, it is readily understood that the positioning and shaping of the ribs and/or stops in the various channels 17, 17' could also be chosen to be, for example, in the form of steps along a sidewall of the respective channels 17, 17'. Additionally, the profile configuration of the cutouts 31–33 an 31'–33', and that of the longitudinal rib 19 and further longitudinal rib are mutually identical and constructed, for example, in the form of triangles; however, since only the height of the stop recesses is of importance, it can readily be appreciated that the cutouts and/or ribs may have a configuration other than a triangular configuration. However, by virtue of providing complementary profiles for the cutouts and/or longitudinal ribs, shape-mating stops are advantageously obtained.

While we have shown and described only one embodiment in accordance with the present invention, it is understood that the same is not limited thereto, but is susceptible of numerous changes and modifications as known to one having ordinary skill in the art, and we therefore do not wish to be limited to the details shown and described herein but intend to cover all such modifications as are encompassed by the scope of the appended claims.

We claim:

1. A cylinder lock including a plurality of plate tumblers disposed in a lock cylinder rotatably received in a lock casing; a locking channel means arranged in the lock casing; an escape channel means arranged in the lock casing at a position diametrically opposed to the locking channel means for enabling a free resetting motion of the plate tumblers during an insertion of a key into the cylinder lock; each of the plate tumblers including a locking end that is operable to be displaced a predetermined distance into the locking channel means when said key is removed from the cylinder lock; a counter end operable to be displaced a predetermined distance into the escape channel means during said resetting motion; and tumbler governing edges adapted to be arranged at levels corresponding with cutout depths of the key; and means for normally urging the locking ends of the plate tumblers into the locking channel means when the cylinder lock is in a locked position with the key removed, characterized in that security means are provided for preventing a determination of respective heights of the tumbler governing edges of the plate tumblers, said security means comprising stop means provided in at least the escape channel means for limiting said resetting motion of the individual plate tumblers to its respective predetermined distance into said escape channel in cooperation with blocking stop means on said counter ends that are cooperable with the stop means for controlling a positioning of the individual plate tumblers, the blocking stop means being arranged in dependence on the respective heights of associated tumbler governing edges, at least some of which are different, so that the tumbler governing edges of the at least some of the plate tumblers which have edges of different height are positioned at the same level when said plate tumblers are maximally displaced into said escape channel.

2. A cylinder lock according to claim 1, characterized in that said stop means includes at least one stop projection means disposed in the escape channel means and adapted to cooperate with the counter end of the individual plate tumblers.

3. A cylinder lock according to claim 2, characterized in that the stop projection is formed by a longitudinal rib having a constant rib height and in that the blocking stop means provided at the counter ends comprise notches, at least some of the notches having different depths, each of said notches being adapted to cooperate with the longitudinal rib.

4. A cylinder lock according to claim 3, characterized in that a depth of the notches provided in at least the counter ends of the respective plate tumblers decreases with an increasing distance from an outermost plate tumbler, as viewed in an insert direction of the key into the cylinder lock.

5. A cylinder lock according to claim 4, characterized in that at least within a group of individual plate tumblers, a distance between a base of the notches and the tumbler governing edge is constant.

6. A cylinder lock according to one of claims 4 or 5, characterized in that, in a locked condition of the cylinder lock, a distance between a tumbler governing edge and a ridge of the longitudinal rib, at least within a group of individual plate tumblers, is constant.

7. A cylinder lock according to claim 6, characterized in that each of the plate tumblers includes a lug cooperable with an end of said urging means, said blocking stop means includes a cylindrical guide surface provided in the lock casing cooperable with a rear edge of said lugs, characterized in that, with an increasing distance of the tumbler governing edge from a counter edge of the plate tumblers, a distance between the rear edge of the lug and the plate locking end is reduced at least within a group of individual plate tumblers.

8. A cylinder lock according to claim 7, characterized in that at least one stop projection is arranged in both the locking channel means and the escape channel means, each of the stop projections being constructed so as to have an identical profile and be disposed in a mirror-image symmetry in the lock casing.

9. A cylinder lock according to claim 8, characterized in that each of the stop projections is constructed as a longitudinal rib of a constant height respectively disposed in the escape channel means and the locking channel means.

10. A cylinder lock according to one of claims 1 or 3, characterized in that each of the plate tumblers includes a lug cooperable with an end of said urging means, said blocking stop means includes a cylindrical guide surface provided in the lock casing cooperable with a rear edge of said lugs, characterized in that, with an increasing distance of the tumbler governing edge from a counter end of the plate tumblers, a distance between the rear edge of the lug and the plate locking end is reduced at least within a group of individual plate tumblers.

11. A cylinder lock according to claim 2, characterized in that at least one stop projection is arranged in both the locking channel means and escape channel means, each of the stop projections being constructed so as to have an identical profile and be disposed in a mirrorimage symmetry in the lock casing.

12. A cylinder lock including a plurality of plate tumblers disposed in a lock cylinder rotatably received in a lock casing; a locking channel means arranged in the lock casing; an escape channel means arranged in the lock casing at a position diametrically opposed to the locking channel means for enabling a free resetting motion of the plate tumblers during an insertion of a key into the cylinder lock; each of the plate tumblers including a locking end adapted to be displaced into the locking channel means; a counter end adapted to be displaced into the escape channel means; and tumbler governing edges adapted to be arranged at levels corresponding with cutout depths of the key; and means for normally urging the locking ends of the plate tumblers into the locking channel means when the cylinder lock is in a locked position with the key removed, characterized in that means are provided for preventing a determination of respective heights of the tumbler governing edges of the plate tumblers, characterized in that said limiting means includes at least one stop projection means disposed in at least one of the escape channel means and the locking channel means, the at least one projection being adapted to cooperate with one of the counter end and locking end of the individual plate tumblers, and further characterized in that at least one stop projection is arranged in both the locking channel means and escape channel means, each of the stop projections being constructed so as to have an identical profile and be disposed in a mirror-image symmetry in the lock casing.

13. A cylinder lock according to claim 11 or 12, characterized in that each of the stop projections is constructed as a longitudinal rib of a constant height respectively disposed in the escape channel means and the locking channel means.

* * * * *